United States Patent [19]
Birx
[11] 4,255,731
[45] Mar. 10, 1981

[54] INTENSE ELECTRON BEAM MICROWAVE SWITCH

[75] Inventor: Daniel L. Birx, Pasadena, Calif.

[73] Assignee: The United States of America as represented by the Secretary of the Navy, Washington, D.C.

[21] Appl. No.: 78,251

[22] Filed: Sep. 24, 1979

[51] Int. Cl.³ ..... H01P 1/14
[52] U.S. Cl. ..... 333/258; 333/13; 333/262
[58] Field of Search ..... 333/258, 262, 248, 13

[56] References Cited

U.S. PATENT DOCUMENTS

| | | | |
|---|---|---|---|
| 2,493,706 | 1/1950 | Washburne et al. | 333/258 |
| 3,078,424 | 2/1963 | Carter et al. | 333/13 X |
| 3,281,719 | 10/1966 | Goldberg | 333/13 X |

*Primary Examiner*—Marvin L. Nussbaum
*Attorney, Agent, or Firm*—Richard S. Sciascia; Thomas M. Phillips

[57] ABSTRACT

Microwave energy is coupled into an elongate waveguide having a rectangular main cavity with a lateral branch forming a T section. An intense beam of electrons is generated in the rectangular cavity at a particular location relative to the T to reflect incident microwave energy and produce a standing wave. Quarter wavelength spacing of the beam from the T positions either a wave node or antinode at the T. Preferably, in its 'open' state, accumulated microwave energy is released as a high power output pulse by establishing an antinode at the T. Alternatively, a node at the T produces a normally 'closed' state. In all arrangements, the beam of electrons, which traverses the central portion of the narrow dimension of the rectangular cavity in a direction parallel to the electrical field of its microwave energy, is of sufficient electron density to assure the desired reflection and produce the interference pattern.

12 Claims, 8 Drawing Figures

FIG. 4.
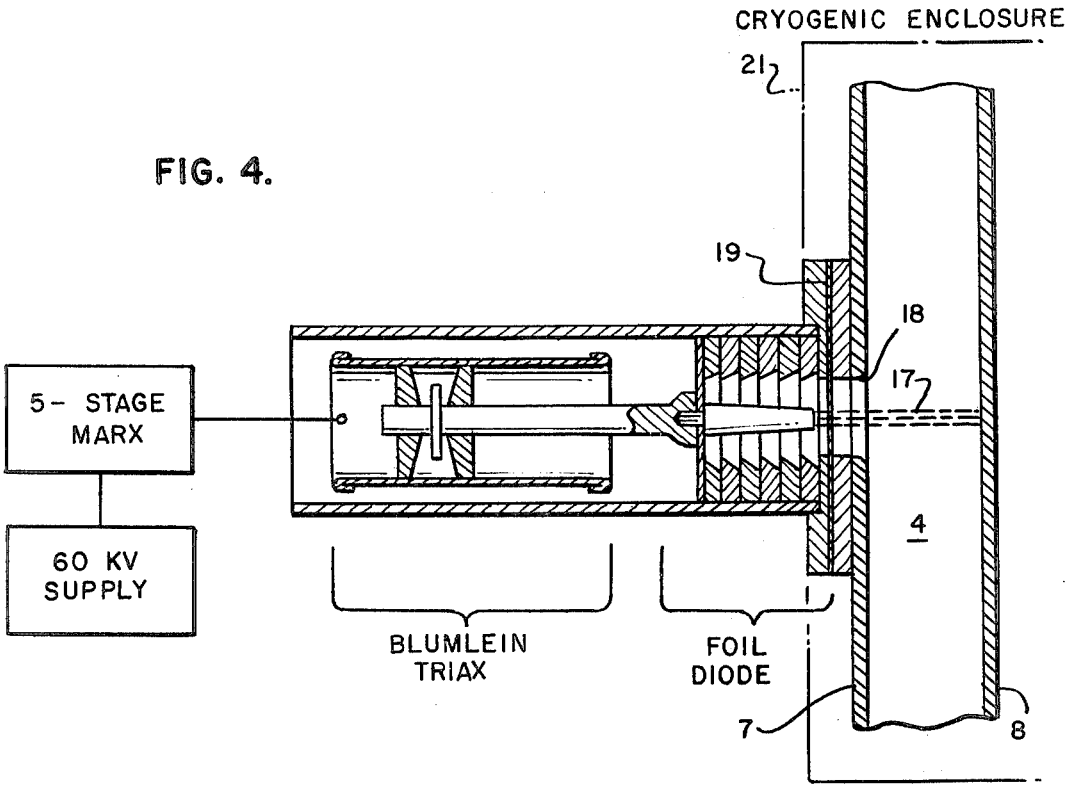
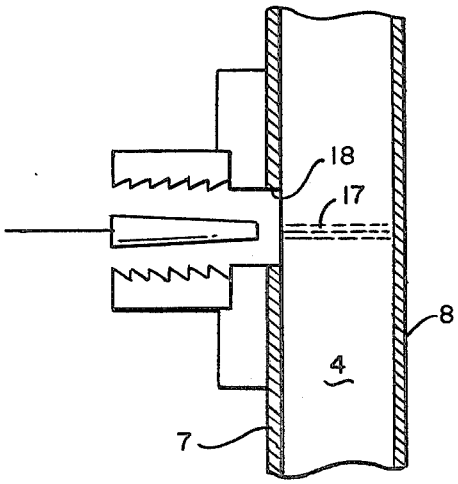
FIG. 5.

FIG. 6.
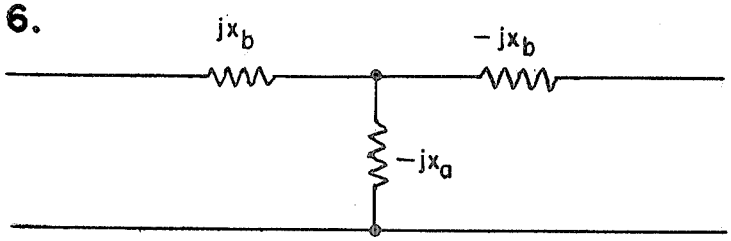
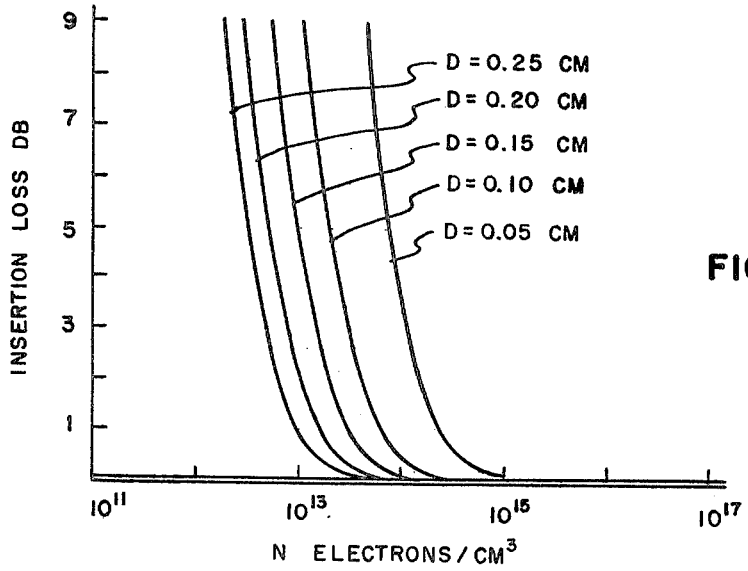
FIG. 7.
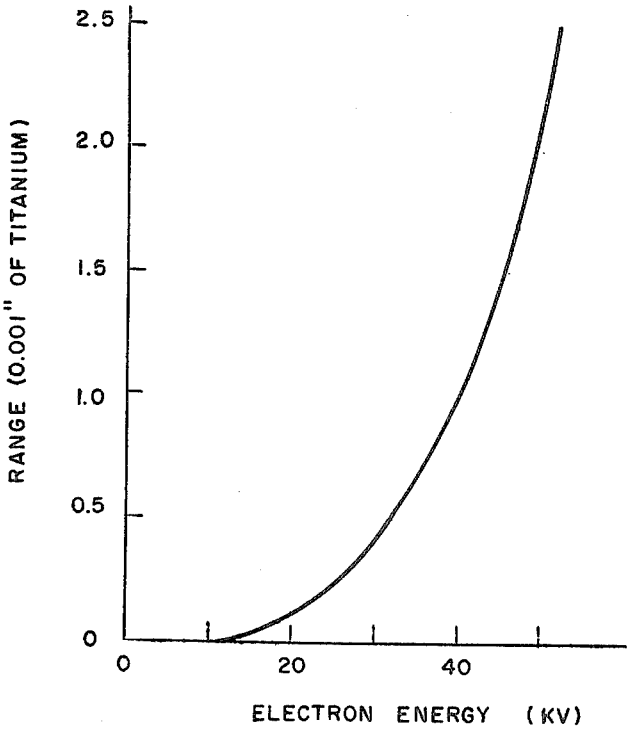
FIG. 8.
RANGE OF ELECTRONS IN TITANIUM

INTENSE ELECTRON BEAM MICROWAVE SWITCH

BACKGROUND OF THE INVENTION

The present invention relates to waveguide switching arrangements for coupling microwave energy to an external load.

As will be described, the present invention essentially is an improvement of a microwave switching concept disclosed in a co-pending patent application, Ser. No. 928,218 "Pulse Generator Utilizing Superconducting Apparatus" filed by the present inventor July 26, 1978, and now U.S. Pat. No. 4,227,153. A publication "Microwave Power Gain Utilizing Superconducting Resonant Energy Storage", Applied Physics Letters (Appl. Phy. Lett. 32(1), January 1, 1978 also discloses this concept.

In these prior disclosures a rectangular waveguide is coupled to a resonator and a low power microwave single source is provided with a lateral branch or T having an H-plane junction with the main cavity of the guide. A short circuit formed at the terminal end of the cavity reflects incident microwave radiations in a standing wave interference pattern and the relative spacing of the short and the T-opening is such that the interference pattern produces a node (point of minimum electrical field density) at the input to the T. The output of the T terminates in a matched load, such as an antenna, which due to the node, is isolated from the microwave energy in the main cavity during its normal operation or, in other words, its 'open' state. To 'close' the switch, the short circuit essentially is displaced toward the T by a quarter wavelength of the microwave signal. The displacement then produces a maximum field intensity (anti-node) at the T to couple the load and release the microwave energy in the form of a high-power pulse.

In its preferred form, the present invention utilizes a configuration similar to that just described. The single fundamental difference involves the manner in which the short circuit is displaced. Thus, in the earlier configuration, a gas discharge tube was physically mounted in the rectangular waveguide cavity at the desired quarter wavelength spacing from the terminal, short-circuit end of the guide. By applying a suitable DC voltage across internal electrodes of the discharge tube, a contained gas, such as Xenon, ionizes to initiate the reflection and produce the antinode which releases the energy to the load.

Although the use of the gas discharge tube is effective and beneficial, there are certain inherent deficiencies. For example, the plasma discharge tube necessarily is positioned in the region of electrical field intensity and, consequently, residial losses associated with it materially limit switch isolation. Thus, in the open position of a switch using superconducting components, an isolation of about 70 db is obtained at s-band. With the discharge tube removed, the s-band experiment has an isolation in excess of 120 db. To a lesser extent, the residual losses are associated with the tuning dielectric. Further, in some applications, both the rise time and the duration time of the output pulse are matters of critical concern. As to rise time, it is affected by the time needed for the gas of a discharge tube to ionize and produce the plasma. With regard to duration time, once the gas is ionized it requires a certain time for its recombination. During this recombination period, it continues to screen microwave reflection.

In the present invention, instead of using an ionizable gas, such as the gas fill of the discharge tube, switching is achieved by generating a beam of electrons directed traversely of the wave guide cavity in a direction parallel to its electrical field. As will be understood, the beam must be sufficiently intense, i.e. sufficient electron density, to produce the reflection and the desired standing wave form. In one form of the invention, the electron beam is generated externally of the waveguide so as to penetrate its wall and traverse the central portion. In another form, a vacuum arc of pure electrons is produced by applying the high voltage to an electrode provided in the waveguide wall.

BRIEF DESCRIPTION OF THE DRAWINGS

The present invention is illustrated in the accompanying drawings of which:

FIG. 4 is a schematic diagram of a high voltage electron beam generator;

FIG. 5 illustrates schematically a modification in which a vacuum arc discharge produces the electron beam;

FIG. 6 is an equivalent circuit for the present beam, and

FIG. 7 is a plot showing a calculated insertion loss of an x-band switch as a function of electron beam density (N) and diameter (D) of the electron beam.

FIG. 8 is a plot illustrating the approximate range of electrons used in one form of the present invention.

DETAILED DESCRIPTION OF THE INVENTION

Figure 1:
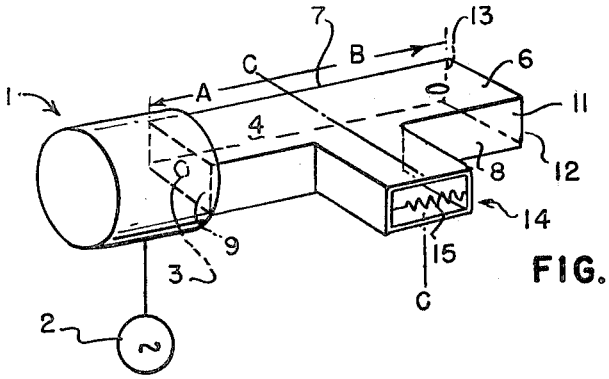
FIG. 1 is a perspective view showing in somewhat schematic form the rectangular waveguide.

Referring to FIG. 1, the switch includes a superconducting resonator 1, such as a lead-plated copper cylindrical resonator, adapted to be pumped to a high energy state by a low power microwave source 2. The source frequency, as is customary, corresponds to the resonant frequency $\omega$ of the resonator and it may be either a CW or a pulsed signal. Coupled to the resonator by way of a suitable aperture 3 is a waveguide 4 having a main rectangular waveguide section or cavity 6 formed by top and bottom walls of 7 and 8, end walls 9 and 11 and side walls 12 and 13. A branch or T-section 14 extends laterally of side wall 12 in open communication with the rectangular main cavity. T-section 14 normally is terminated in a matched load (not shown) which, for example, may be an antenna. For descriptive purposes, it can be considered that the main waveguide section 6 is formed of two continuous arms A and B, arm A extending from input end wall 9 to the longitudinal center of T-section 14, designated line C, and arm B extending from terminal wall 11 to line C.

Figure 2:
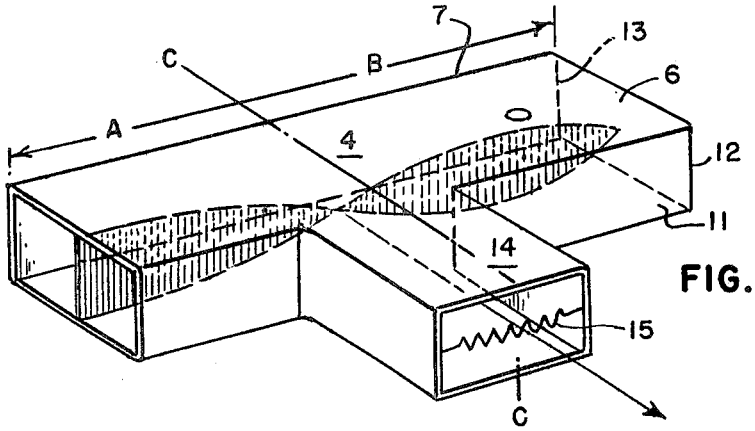
FIG. 2 is a similar perspective illustrating the standing wave produced by the short circuit at the terminal end of the waveguide.

Terminal end 11 is, in effect, a short circuit capable of reflecting incident microwave energy in the form of a standing wave 16. As shown in FIG. 2, this wave which is produced by the incident and reflected traveling waves has the usual nodes and antinodes or, in other words, points of minimum and maximum electrical field intensity. In what will be referred to as an 'open' state, short circuit 11 is spaced from center line C to produce a nodal condition at line C. To achieve this 'open' state, the length of arm B is a quarter wavelength of the microwave signal ($\lambda g/4$) or an even multiple of ($\lambda g/4$). The node at center line C then prevents coupling of electromagnetic energy from the main waveguide cavity to external load 15 and the load consequently is isolated from the resonator and its microwave source. Substantially all of the power supplied to the resonator remains stored permitting it to charge to a high microwave energy state.

Figure 3:
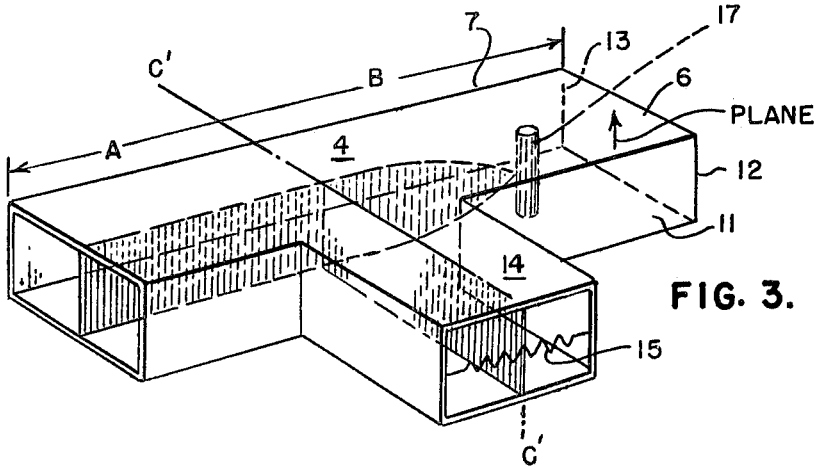
FIG. 3 is a view similar to FIG. 2 illustrating the standing wave as produced by the present electron beam.

According to the present invention, release of the stored energy in the form of a high power pulse is achieved by producing an electron beam 17 (FIG. 3) which traverses the narrow dimension of the guide along its center line. In effect, the beam displaces the short circuit of terminal end 11 a quarter wavelength of the microwave signal ($\lambda g/4$), or an odd multiple thereof, away from the terminal end short or, in other words, a quarter wavelength closer to center line C. The displacement results in the formation of the standing wave shown in FIG. 3 which, as will be noted, has an antinode disposed at the center line. Power, therefore, flows from the main waveguide section to the external load in what can be considered as a 'closed' state.

Generation of electron beam 17 serves essentially the same purpose as the previously-discussed gas discharge tube described in the cited reference. The difference is that the present interference pattern is produced using the beam of electrons to reflect incident radiation rather than by the use of the gas-filled discharge tube that requires ionization and recombination. Operationally, the rise time of the output pulse can be increased and its duration time shortened. Residual losses associated with the plasma discharge tube also are minimized. For example, it has been shown that the isolation of the gas discharge tube switch is materially increased when the gas discharge tube is removed from its region of electrical field intensity. Comparable experiments show that the electron beam switch achieves an isolation essentially equal to that of the discharge tube switch with the discharge tube removed.

As has been indicated, electron beam 17 traverses the wave guide cavity in a direction parallel to the electrical field of its energy (FIG. 3) and its electron density should be in the order of $10^{12}$ electrons/cm$^3$ or more. For this purpose, a high voltage power supply subsequently to be described, can be used. The geometry of the beam is not particularly critical especially when operations are at gigahertz wavelengths and the beam is oriented to traverse the central portion of the narrow dimension of the waveguide. A small diameter beam is capable of reflecting the electrical field.

The formation of the electron beam can be accomplished in different manners. As illustrated in FIG. 4, it is generated externally of waveguide cavity so as to penetrate cavity wall 7 and traverse the cavity to opposite wall 8. In practice, cavity wall 7 can be formed with a small opening 18 covered by a titanium foil 19 to facilitate penetration. Alternatively, wall 7 simply can be thinned in the area of opening 18 and the beam projected so as to physically penetrate this thin portion. The voltage needed to produce such a beam is determined by its electron penetration requirements. Obviously, it must possess sufficient energy to penetrate the foil or the thin portion of the wall as well as any gas that may be in the waveguide. In this regard, although the use of gas within the waveguide requires an increase in the energy requirements, the gas nevertheless is beneficial since it inhibits physical problems arising from the use of the very high field strengths. A gas such as sulfur hexafluoride ($SF_6$) or other similar gases can be used.

The electron beam generator mechanism shown in FIG. 4 is entirely conventional. As shown, it employs a five-stage Marx generator resonantly charging a 60 cm length of Blumlein Triax to about 300 kv. To pulse this high voltage power supply, the Triax section incorporates a conventional $SF_6$ switch adapted to break down at the 300 kv level to deliver a 300 kv pulse to a 50 ohm foil diode. The diode, in turn, generates an 8 kamp beam of electrons to penetrate foil 19 and traverse the waveguide at relativistic velocities for impaction on the far wall of the waveguide. This specific high voltage arrangement can, of course, be implemented in different manners providing an electron beam is produced having sufficient intensity to penetrate the waveguide and conductively reflect the electrical field of its microwave energy. In the titanium foil arrangement illustrated in FIG. 4, experiments have shown that the beam reaches full intensity in approximately 1 nsec with a duration of 5 nsec. However, if the waveguide contains a sufficient density of gas, the recombination time will increase the output pulse duration. Also, the voltage requirements provided in the described example will vary considerably according to conditions such as the presence of gas or the power needed to penetrate the titanium foil. A study has been made of the approximate range of electrons in titanium as a function of electron energy. FIG. 8 is a plot showing this relationship. When a gas is enclosed in the waveguide, there is a substantial increase in the electron energy requirements. For example, blooming of the electron beam over a distance in the gas is a significant consideration in an s-band switch so that proper performance of such a switch may require higher voltage than indicated. In x-band operation and higher frequencies, the blooming of the electron beam is not a serious problem since the waveguide is relatively small.

An alternate arrangement for producing electron beam 17 is illustrated in FIG. 5. In particular, although this arrangement can use the same 300 kv high voltage power source of FIG. 4, the voltage pulse is applied to electrode 18 so as to produce a vacuum arc discharge 20 having sufficient plasma density for reflection purposes. Arc 20 is, in effect, a beam of electrons similar in function and purpose to beam 17. One advantage of the vacuum arc arrangement is that the energy needed to penetrate the cavity wall is not required. As in the beam 17 arrangement, nanosecond rise times again are possible. However, the duration of the output pulse produced by arc discharge is somewhat extended because the discharge usually will be formed not only of electrons but also of metal atoms which pulled off of the walls and ionized by the electrons. To this extent that this occurs, recombination time of the metal ions is required.

The present electron beam switch has been operated both in a superconducting environment and at room temperature. Superconducting components, of course, materially improve performance but are not essential to effective operation of the device as a switch. In superconducting arrangements, a cryogenic enclosure 21 (FIG. 4) can be used. The Marx-generator then feeds a glass-insulated, pulse-shaped line extending through the cryogenic enclosure to the generator which can be at room temperature.

Successful functioning of the present switch depends largely upon the effects of electron beam 17 upon incident microwave radiation and, in the present development, these effects have been analyzed mathematically as well as experimentally. In the mathematically analysis, electron beam 17 is considered equivalent to a rod of dielectric constant given by $$\epsilon(\omega) = \epsilon_0 (1 - \frac{\omega_p 2}{\omega^2})$$

with $$\omega_p 2 = \frac{4\pi N e^2}{m}$$

where N is the electron density.

An equivalent circuit for a waveguide containing the centered electron beam extending parallel to the E-plane is provided in FIG. 6. In this equivalent circuit the relationships are as follows:

$$\frac{X_a}{Z_o} - \frac{X_b}{2Z_o} = \frac{a}{2\lambda_g}\left[\frac{J_o(\beta)}{J_o(\alpha)} \frac{1}{\beta J_o(\alpha)J_1(\beta) - \alpha J_o(\beta)J_1(\alpha)} - y + \frac{\alpha^2}{4}\right]$$

and $$\frac{X_b}{Z_o} = \frac{\frac{2a}{\lambda_g}(\frac{\pi D}{a})^2}{\alpha^2 \frac{J_1(\beta)}{J_1(\alpha)} \frac{1}{\alpha J_o(\alpha)J_1(\beta) - \beta J_o(\beta)J_1(\alpha)}} - 2$$

with $$\alpha = \frac{\pi D}{\lambda}, \beta = \sqrt{\epsilon}\ \frac{\pi D}{\lambda},$$

$$y = \ln(\frac{4a}{\pi D}) - 2 + 2 \sum_{n=3,5}^{\infty} \left(\frac{1}{n^2 - (\frac{2a}{\lambda})^2)^{\frac{1}{2}}} - \frac{1}{n}\right)$$

In the above, D is the diameter of the electron beam, Ja is the width of the guide, and $J_0$ and $J_1$ are bessel functions of zero and first order respectively.

The calculated insertion loss of an x-band switch as a function of electron beam density, N, and diameter D in cm shown in FIG. 7. An insertion loss of 0.5 DB at x-band and 3 DB at s-band has been experimental.

The experiments which have been conducted also indicate the power gain achieved by the storing and releasing function of the electron beam switch. Thus, as will be recognized, a microwave resonator driven by a low power source for a period determined by its decay time produces an output pulse upon switch closure at a power level given by:

$$\text{Pout} = \text{Pin} \frac{T\,\text{store}}{T\,\text{release}} (1 - \epsilon)$$

where $\epsilon$=fraction of power absorbed in the plasma and T store=Q cavity/$\omega$.

A power gain (Pout/Pin) of $3 \cdot 10^4$ was achieved at x-band. The output pulse was 15 ns in duration and was produced by a superconducting cylindrical resonator operation in the $TE_{011}$ mode with a loaded Q, $QL = 3 \times 10^7$.

A similar experiment, involving a room temperature, gas-filled resonator, employed a shorted section of an s-band waveguide 21 cm in length. The output pulse was approximately 3 nsec in duration at a power level of about 50 × the input power.

The electron beam switch primarily is intended to be used for the purpose of suddenly releasing very large amounts of stored energy accumulated in a waveguide during its so-called 'open' state. Due to the high isolation as well as its switching times of about 1 nsec and its low insertion loss, this storage and release capability is substantially improved. However, it also is to be noted that reverse operations can be achieved. Thus, in addition to the described shunting of a normally open transmission, the switch also can be used to open a line that normally is closed. For example, the standing wave produced in the normally 'open' state can be configured to provide an anitnode at the centerline of discharge port 14 so that node 15 normally is coupled to the resonator and the switch, in effect, is normally 'closed'. When electron beam 17 is generated, a nodal condition exists at the centerline isolating the load from the resonator and, in effect, opening the switch. Both of these modes of operation have been demonstrated with waveguides containing up to 5 atmospheres pressurization of the variety of different gases.

The particular advantages of the switch have been discussed. In general, they involve the excellent low loss isolation, the improved rise and duration times and the low insertion upon energy release. Comparatively, switching arrangements using gas discharge tubes or other forms of ionized gas show a greater loss during storage and considerably longer output pulse duration times.

Obviously many modifications and variations of the present invention are possible in the light of the above teachings. It is therefore to be understood that within the scope of the appended claims the invention may be practiced otherwise than as specifically described.

I claim:

1. Microwave switch apparatus comprising:

a waveguide formed of wall members providing a cavity having a continuously elongate main extent formed by first and second arm sections and a branch arm joined in open communication with said first and second sections at their junctures, said second arm section having at its distal end a short circuit member for reflecting incident microwave energy radiations in a standing wave pattern capable of controlling said branch arm coupling, means for generating electromagnet microwave energy radiations in said cavity, a high voltage power supply, and transmission means driven by said high voltage supply for controllably generating within said second arm section a beam of electrons extending transversely of its cavity essentially parallel to the electrical field of said generated radiations, said beam being of sufficient density to reflect said component and form a standing wave interference pattern having nodes and antinodes disposed at fixed positions in said main cavity extent relative to said branch arm juncture, said transverse location of said electron beam relative to said juncture being such that the electrical field intensity of said standing wave interference pattern at said juncture controls the coupling of said microwave energy into said branch arm whereby said coupling is switchably responsive to said electron beam.

2. The switch apparatus of claim 1 wherein the length of said second arm section between its juncture and its distal end short circuit member is such that the standing wave reflected by said short circuit member has a node at said juncture whereby said generated microwave energy does not couple to said branch arm and is stored in said main waveguide cavity extent.

3. The switch apparatus of claim 2 wherein said electron beam is formed at such a transverse location that its standing wave interference pattern has an antinode at said juncture whereby the controllable generation of said beam couples said stored microwave energy into said branch arm.

4. The switch apparatus of claim 3 wherein said means for generating said electromagnetic microwave energy radiation in said cavity includes:

a cavity resonator coupled into said waveguide cavity, and a microwave signal source coupled to said resonator for charging it to a high energy condition, the frequency of said source corresponding to the resonant frequency of said resonator, said length of said second arm section and said location of said electron beam being a function of the wavelength of said microwave signal.

5. The switch apparatus of claim 4 wherein said resonator and waveguide are superconducting members, said switch apparatus further including a cryogenic enclosure for said superconducting members.

6. The switch apparatus of claim 4 wherein said transmission means is controllably pulsed, said electron beam generated by said pulsed means being capable of reaching its maximum density in about 1 nsec and having a duration of about 5 nsec.

7. The switch apparatus of claim 6 wherein the ratio of the power output in the microwave energy coupled into said branch arm to the power input of said microwave signal source is about $3\times10^4$.

8. The switch apparatus of claim 1 wherein said transmission means generates said electron beam exteriorally of said waveguide cavity, said beam being of sufficient intensity to penetrate a wall member of said second arm section and transverse its cavity with an electron density sufficient for reflecting said radiations.

9. The switch apparatus of claim 8 wherein said wall member of said second arm section is thinned at said penetration location.

10. The switch apparatus of claim 8 wherein said wall member of said second arm section is provided with an opening at said penetration location, said opening being covered with a foil member facilitating the penetration.

11. The switch apparatus of claim 1 further including an electrode means mounted in a wall member of said second arm section, said transmission means applying said high voltage power to said electrode for establishing an electrical potential transversely across said second section cavity, said arc providing a transverse electron beam of sufficient density to reflect said radiations.

12. The switching apparatus of claim 11 wherein said transmission means is controllably pulsed.

* * * * *